US007987901B2

(12) United States Patent
Krueger et al.

(10) Patent No.: US 7,987,901 B2
(45) Date of Patent: Aug. 2, 2011

(54) ELECTRICAL CONTROL FOR A DOWNHOLE SYSTEM

(75) Inventors: Sven Krueger, Winsen (DE); Otto N. Fanini, Houston, TX (US); Matthias Reinhard Moeller, Braunschweig (DE); Karsten Fuhst, Hannover (DE)

(73) Assignee: Baker Hughes Incorporated, Houston, TX (US)

( * ) Notice: Subject to any disclaimer, the term of this patent is extended or adjusted under 35 U.S.C. 154(b) by 113 days.

(21) Appl. No.: 12/568,284

(22) Filed: Sep. 28, 2009

(65) Prior Publication Data

US 2010/0078161 A1 Apr. 1, 2010

Related U.S. Application Data

(60) Provisional application No. 61/100,934, filed on Sep. 29, 2008.

(51) Int. Cl.
*E21B 47/024* (2006.01)
*E21B 49/10* (2006.01)

(52) U.S. Cl. ..... 166/55; 166/65.1

(58) Field of Classification Search ..... 166/55, 166/55.2, 65.1, 66, 72; 175/104
See application file for complete search history.

(56) References Cited

U.S. PATENT DOCUMENTS

| | | | | |
|---|---|---|---|---|
| 4,624,136 | A | 11/1986 | Delatorre | |
| 4,849,699 | A * | 7/1989 | Gill et al. | 324/339 |
| 4,852,648 | A * | 8/1989 | Akkerman et al. | 166/66.4 |
| 5,236,048 | A * | 8/1993 | Skinner et al. | 166/382 |
| 6,868,901 | B2 | 3/2005 | Mason | |
| 7,152,680 | B2 | 12/2006 | Wilson | |
| 2003/0155120 | A1 * | 8/2003 | Richards et al. | 166/250.01 |

OTHER PUBLICATIONS

International Search Report for Related PCT Application PCT/US2009/058822 dated Mar. 31, 2010.

* cited by examiner

*Primary Examiner* — Daniel P Stephenson
(74) *Attorney, Agent, or Firm* — Bracewell & Giuliani LLP

(57) ABSTRACT

A method for controlling the electrical power delivered to a downhole system. The downhole system may include a power supply, a downhole tool, and a wire or cable connecting the downhole tool to the power supply. A resistive load, such as a motor, is included with the downhole tool. The power supplied to the downhole tool is dynamically adjustable to match the resistive load voltage and power rating. Dynamically adjusting power is accomplished by varying voltage from the power supply, varying the resistive load requirements, or a combination of both.

21 Claims, 7 Drawing Sheets

$$R_{WL} = \frac{V_{SURF} - V_{CH}}{I_{SURF}}$$

ELECTRICAL CONTROL FOR A DOWNHOLE SYSTEM

RELATED APPLICATIONS

This application claims priority to and the benefit of copending U.S. Provisional Application Ser. No. 61/100,934, filed Sep. 29, 2008. This application also claims priority from and is a continuation-in-part of copending application Ser. No. 12/324,457, entitled Tubular Cutting Device filed Nov. 26, 2008, which is a divisional of U.S. Pat. No. 7,478,982 issued Dec. 28, 2008, entitled Tubular Cutting Device filed Oct. 24, 2006 and assigned Ser. No. 11/585,447; which are incorporated by reference herein in their entireties.

BACKGROUND

1. Field of Invention

The invention relates generally to the field of oil and gas production. More specifically, the present invention relates to a method and system for controlling electrical power for a downhole system.

2. Description of Prior Art

Many downhole tools used in hydrocarbon producing wellbore operations are electrically powered. The power is typically provided by a power source at the wellbore surface that connects to a wireline coupled with the tool. The downhole tools include devices, that when operational, provide a resistive load energized by the power source via the wireline or cable.

The downhole tools' resistive load varies during the subterranean operations that cause fluctuations in the current delivered from the power supply. This also alters the voltage supplied to the downhole tool and its corresponding resistive load. The operational fluctuations in current and voltage may allow the resistive load to operate outside of its optimum or rated operating range thereby lowering its efficiency. Similarly, these fluctuations can produce current and voltage values in the wireline that are outside of its maximum power transfer range.

SUMMARY OF INVENTION

Disclosed herein is a method of operating a downhole tool in a wellbore. The method includes supplying electrical power to the downhole tool from a power source through a wireline, monitoring current from the power source, and regulating the voltage from the power source to the wireline based on the step of monitoring current to thereby optimize power transfer through the wireline. The wireline has an electrical impedance that can be modeled mathematically. The downhole tool has a resistive load with a rated input voltage. The method may further involve consulting an impedance model of the wireline, comparing the impedance model with the rated input voltage, and controlling the voltage from the power source based on the step of comparing the impedance model with the rated input voltage. The impedance model can be used to identify wireline operating conditions where maximum power transfer across the wireline occurs. The method also may include regulating the voltage from the power source so the downhole tool is operated within its rated input voltage range thereby minimizing the difference between the resistive load operating conditions and the conditions of maximum power transfer across the wireline. The downhole tool may have a varying resistive load thus the current usage of the resistive load can be adjusted based on the step of monitoring current. In one embodiment, the downhole tool may be a tubular cutting device having a cutting element driven by a motor, where the motor comprises a varying resistive load and the step of regulating current usage comprises varying the cutting element feed rate. In one example, the conditions of maximum power transfer across the wireline relate voltage and current. The method further comprises repeating the steps of monitoring current and of regulating voltage. Repeating the steps of monitoring current and of regulating voltage may occur within a time period thereby approximating continuous monitoring and regulating to create a dynamic monitoring and control system.

Also disclosed herein is a method of optimizing power transfer through a cable. The cable is connected to a downhole tool disposed in a wellbore, wherein the downhole tool includes a resistive load having a rated voltage. The method includes obtaining an impedance model for the cable, where the impedance model illustrates a corresponding voltage and current for maximizing power transfer through the cable. Power is supplied to the cable from a power source and current from the power source is monitored. The voltage at the downhole tool is determined based on the step of monitoring current and the impedance model. The power supply output voltage is regulated to maximize power through the cable. The method may also comprise regulating the current demand of the downhole tool to maximize power through the cable. In one embodiment the downhole tool comprises a tubular cutting device having a cutting element driven by a motor, where the motor comprises a varying resistive load and the step of regulating current usage comprises varying the cutting element feed rate. The method may also dynamically monitor electrical power conditions and dynamically adjust power supply to maximize power to the downhole tool. Cutting operations on various tubulars may be performed and the power usage per time of cut recorded. Based on the recordings a database of power usage per time of cut can be created. A new cutting operation can begin where its power usage is recorded, based on the new cut data and the database data, a required power usage of the new cutting operation can be predicted.

The present disclosure also includes a downhole system of a power source, a resistive load disposable in a wellbore, the resistive load having a designated value of input voltage, a wireline electrically connecting the power source to the resistive load, and a controller associated with the power source. The controller may be configured to monitor current from the power source, evaluate the actual voltage in the wireline based on the monitored current and wireline impedance, and maximize power transfer through the wireline by regulating the voltage from the power source based on a model of a wireline impedance power curve.

BRIEF DESCRIPTION OF DRAWINGS

Some of the features and benefits of the present invention having been stated, others will become apparent as the description proceeds when taken in conjunction with the accompanying drawings, in which.

Figure 1:
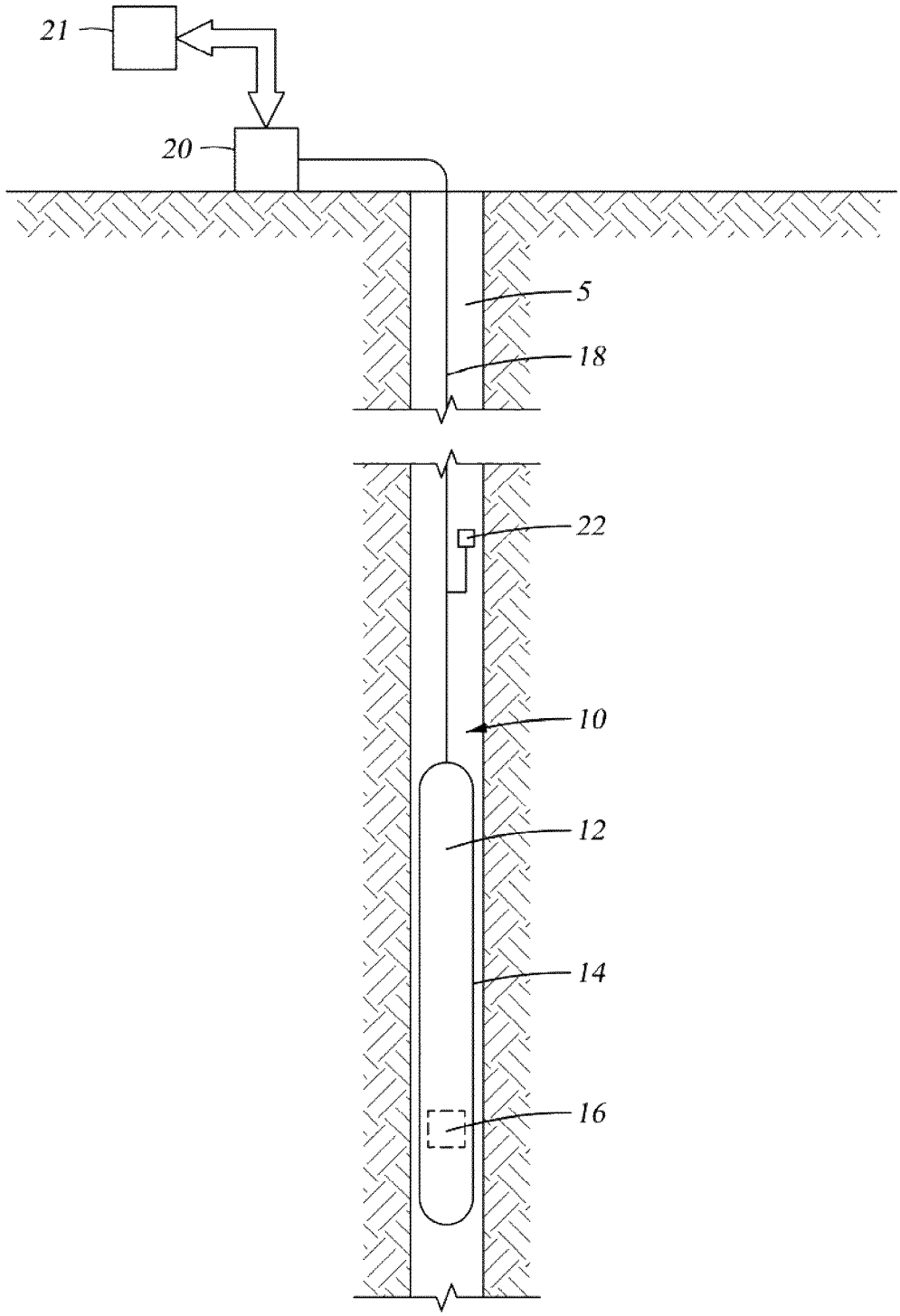
FIG. 1 is a side partial cross-sectional view of a downhole system, having a downhole tool disposed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

With reference now to FIG. 1 one embodiment of a downhole system 10 is shown in a side view. The system 10 includes a power source 20, a downhole tool 12 disposed within a wellbore 5, and a cable 18 providing electrical connection between the power source 20 and the downhole tool 12. Cable 18 can be any one of a number of various devices for providing electrical power to downhole tools, optionally the cable can also provide a lowering and raising means within the wellbore for the downhole tool 12. Accordingly, in one embodiment the cable 18 may comprise an armored wireline. The tool 12 includes an outer housing 14 with a resistive load 16 (shown in dashed outline) retained therein. The resistive load 16 can include any device that consumes, uses, or stores electricity. Electricity can include electrical current, voltage, and/or electrical power. Moreover, the electricity delivery rate to the resistive load 16 can vary. In one example, the resistive load 16 consumes electrical current that varies due to a different operating environment or application of the resistive load 16.

A controller 21 is shown operatively coupled to the power supply 20 by a double-headed arrow. The controller 21 may be integrally contained with the power supply 20 or remote from the power supply 20. The controller 21 may be directly coupled to the power supply 20 or may communicate over a communication link. The communication may be in the form of digital data or an analog signal. Optionally, the controller 21 may be manually operated by personnel at surface. The controller 21 may be configured to have preset commands, stored therein, or can receive commands offsite or from another location. In one embodiment the controller 21 includes an information handling system (IHS). The IHS may also be used to store recorded data as well as processing the data into a readable format. The IHS may be disposed at the surface or in the wellbore 5, as well as partially above or below the surface. The IHS may include a processor, memory accessible by the processor, nonvolatile storage area accessible by the processor, and logics for performing controlling steps described herein.

Also optionally provided with the downhole system 10 is an electrical clamp 22 shown connected to the cable 18. The clamp 22 is adjustable and employed to prevent voltage excursions above a predetermined value. An example voltage clamp 22 includes a variable resister designed to operate upon detection of a set voltage. The clamp 22 can dissipate electricity, such as voltage, in or supplied to the system 10 that cannot be delivered to the resistive load 16. This may occur when the resistive load 16 is not consuming electricity due to being idle or otherwise inoperable.

Figure 2:
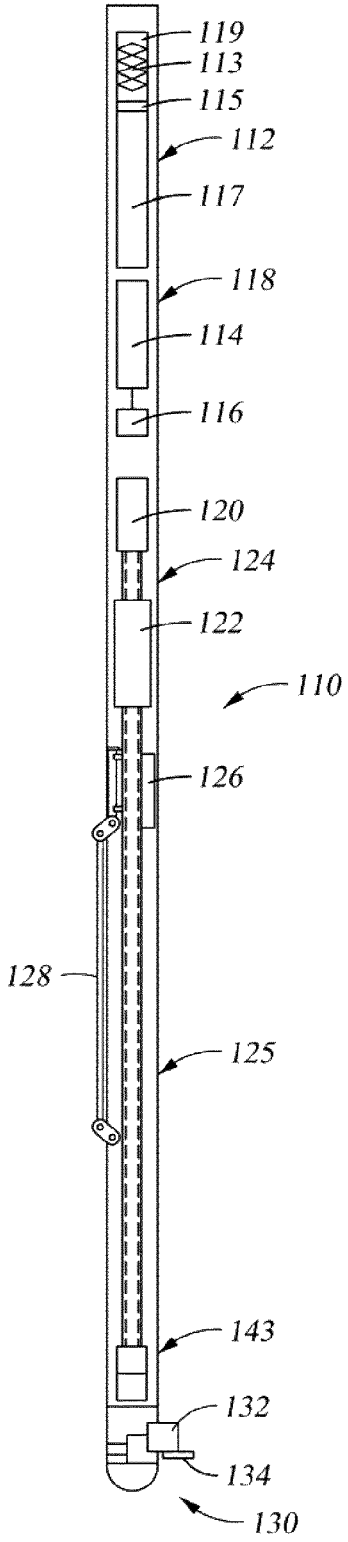
FIG. 2 provides a side partial cross-sectional view of an embodiment of a cutting tool.

With reference now to FIG. 2 one example of a cutting tool 110 is shown in a side partial sectional view. In the embodiment shown the cutting tool 110 includes a compensation section 112, a pump motor 114, a pump 116, a hydraulics section 118, a feed motor 120, a main motor 122, a motor section 124, a clamping section 125, a piston 126, a clamping rod 128, and a cutting head section 143. Also optionally including with this embodiment of the cutting tool 110 is an electronic section and a cable head section (not shown).

The compensation section 112 includes a cylinder 117 with a piston 115 and adjacent spring 113 disposed therein. A port (not shown) is formed through the tool 110 housing on the spring 113 side of the piston 115. The piston 115 side opposite the spring 113 contacts hydraulic fluid in the tool 110. The piston 115 is moveable axially within the tool 110 in response to a pressure differential between ambient and hydraulic fluid pressure. If the ambient pressure exceeds the tool pressure the piston 115 will be forced downward in the cylinder 117 thereby increasing the pressure in the cutting tool 110 to match the ambient pressure. Pressure compensating the tool can significantly reduce pressure differential across seals for preventing fluid leakage into the cutting tool 110.

The cutting head section 143 includes a cutting head 130 having a cutting member 134 (or cutting element) that outwardly pivots from the cutting head 130. Rotating the cutting member 134 provides a cutting function, thus the cutting tool 110 may sever the entire circumference of a tubular by rotating the cutting member 130 while simultaneously outwardly pivoting the cutting member 134 into cutting contact with the tubular. Example tubulars include downhole tubing, casing, risers, and the like. The cutting member 134 is shown mounted on the end of a pivot housing 132, the pivot housing 132 is pivotable outward from the cutting head 130 for pivoting the cutting member 134 into cutting engagement. In one embodiment, a drive system delivers rotational force for rotating the cutting member 134 and the cutting head 130 while a pivoting system provides the force for pivoting the member 134 outward. One embodiment of the drive system comprises the main motor 122 connectable to a drive shaft 142 that rotates both the cutting head 130 and cutting member 134.

Figure 3:
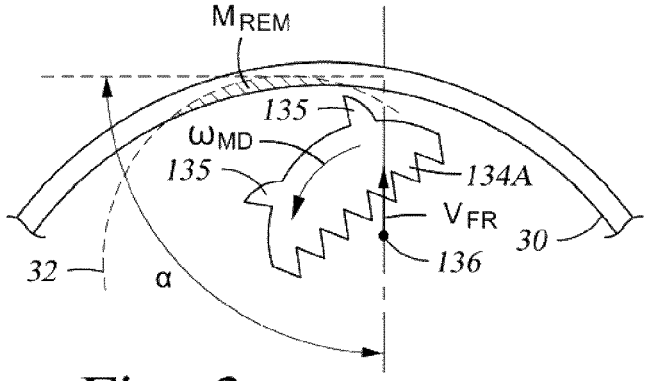
FIG. 3 is a graphical representation of a cutting member engaging a tubular.

FIG. 3 schematically illustrates in elevational view, the cutting member 134A of the tool 110 cutting a tubular. Teeth 135 on the cutting member 134A follow a path 32 defined by member 134A rotation about its axis, cutting head 130 rotation, pivot housing 132 pivot rate, pivot housing 132 pivot angle. The amount of tubular material removed, $M_{REM}$ is based on the intersection of the path 32 and tubular inner diameter 30. As shown, $M_{REM}$ represents the amount of material removed for one rotation of the member 134 and its associated tooth edge path 32 as it cuts into the tubular inner diameter surface. $V_{FR}$ represents the member 134A feed rate radial linear velocity, i.e. instantaneously velocity towards the tubular. $\Omega_{MD}$ represents the member's 134A angular velocity around its shaft 136. As shown in FIG. 3, $L_{TAN}$ intersects the point where the tooth 135 contacts the tubular inner circumference and extends now al to $V_{FR}$.

Figure 4:
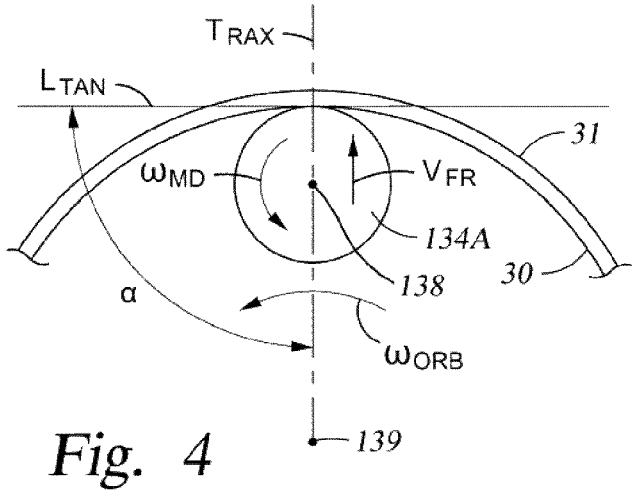
FIG. 4 is a side representation of a cutting element cutting a tubular.

FIG. 4 illustrates a sectional view of a tubular having inner diameter surface line 30 and outer diameter surface line 31; cutting member 134A is shown contacting the tubular inner diameter 30. The member 134A rotational rate around the tubular center 139 is represented by $\Omega_{ORB}$ that considers the distance between the tubular center 139 and the member 134A center 138. $T_{RAX}$, shown passing through the center points 138, 139, represents the tool radial axis line at the cutting member 134A cutting point. A line tangent to the pipe inner diameter 30 at the cutting member 134*a* cutting point is represented by $L_{TAN}$. The angle $\alpha$ illustrates the angular relationship between the line $T_{RAX}$ and line $L_{TAN}$. The angle $\alpha$ is 90° for a perfectly centered cutting device and/or cutting element and an ideal round pipe or other tubular. FIGS. 3 and 4 also illustrate motion speeds for the milling disk head. It should be pointed out that the illustrations provided in FIGS. 3 and 4 are for an ideal case with a substantially round pipe and the tool centered therein.

Figure 5:
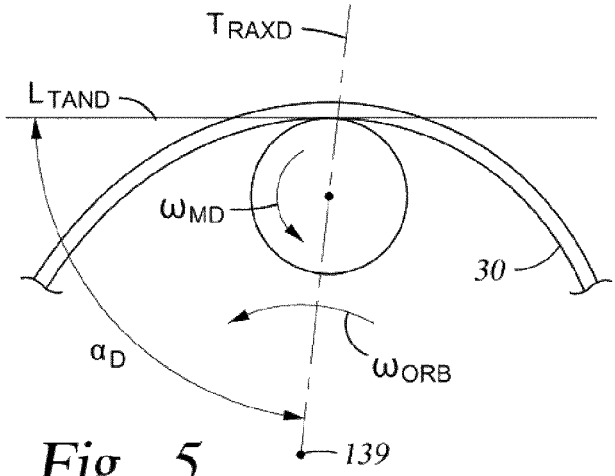
FIG. 5 is a graphical representation of a cutting element within a deformed pipe.

Some pipe cutting operations include deformed pipes having non-circular, such as oval, shapes. This type of pipe deformation occurs whenever the pipe is bent with a radius of curvature required to follow the well path as it was drilled into the formation producing targets. A cutting scenario of a deformed or other wise non-circular tubular is illustrated FIG. 5. Here the angle $\alpha_D$ between the tangent line $L_{TAND}$ and the tool radial alignment axis $T_{RAXD}$ is less than 90°. The angle $\alpha_D$ varies inversely depending on tubular deformation; the higher the tubular deformation at the cutting point the smaller the angle $\alpha_D$ will be. Tubular deformation decreases tubular radius at locations on the circumference. The mass removed $M_{REM}$ increases when cutting tubular portions having a localized decreased radius; conversely, $M_{REM}$ decreases when cutting tubular portions having a localized increased radius. Since the electricity consumed by the cutting tool 110 is dependent on the rate of tubular mass removed during cutting, tubular radius fluctuations, such as caused by deformations, affects cutting tool 110 electrical power requirements.

Figure 6:
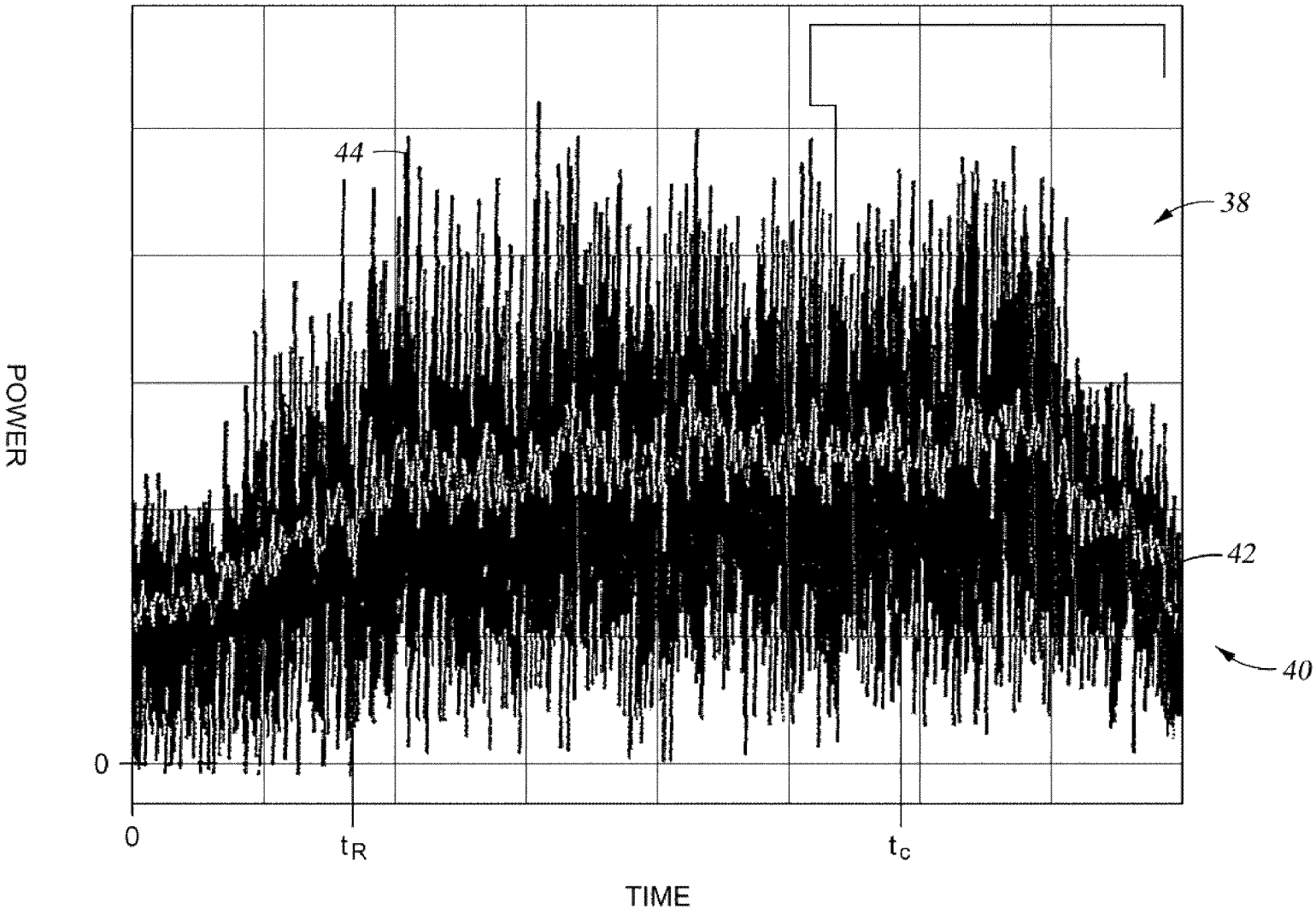
FIG. 6 is a graphical illustration of an example of a cutting sequence of power versus time.

FIG. 6 provides a plot 38 of an example of power (ordinate) vs. time (abscissa) for an example of a cutting tool 110. The abscissa includes two notations; (1) $t_R$—transition from ramp up to cut and (2) $t_c$—end of cut. The time period from T=0 to $t_R$, referred to herein as the ramp up period describes an initial phase of the cutting process; during the ramp up period the cutting element teeth can progressively make deeper cuts into the tubular inner diameter. More specifically, each individual cutting tooth engages an increasing volume of tubing material thereby requiring additional power. At the end of the ramp up period $t_R$ the individual teeth 135 engage substantially the same amount of material over time until the end of the cutting sequence. Accordingly, the power consumption is relatively constant during this period of time. This is illustrated in the plot of FIG. 6 in the power line between $t_R$ and $t_C$. The time of cut can be found by the difference in time value between $t_R$ and $t_C$.

FIG. 6 also illustrates a reduced power requirement when the cut is complete at time values greater than $t_C$. A voltage clamp 22 can be implemented to receive electrical power within the downhole system during the reduced power requirement. More specifically, the plot 38 of FIG. 6 comprises a power band 40 represented by the distance between the upper power spikes 44 and the lower values of power of the plot 38. The average power 42 during the cut is shown generally in the mid-section of the band 40. In one embodiment, the data from various cuts can be collected and supplied into a database, such as in the form of the plot 38 of FIG. 6. A new cut can be initiated and the time versus power plot can be recorded to estimate values plotted in FIG. 6. This may be accomplished by comparing the data obtained from the new cut to the previous cut database to estimate overall expected power and power usage per time. Using this estimated data, the control of the power supply may be optimized or regulated to anticipate the predicted power usage.

Figure 7:
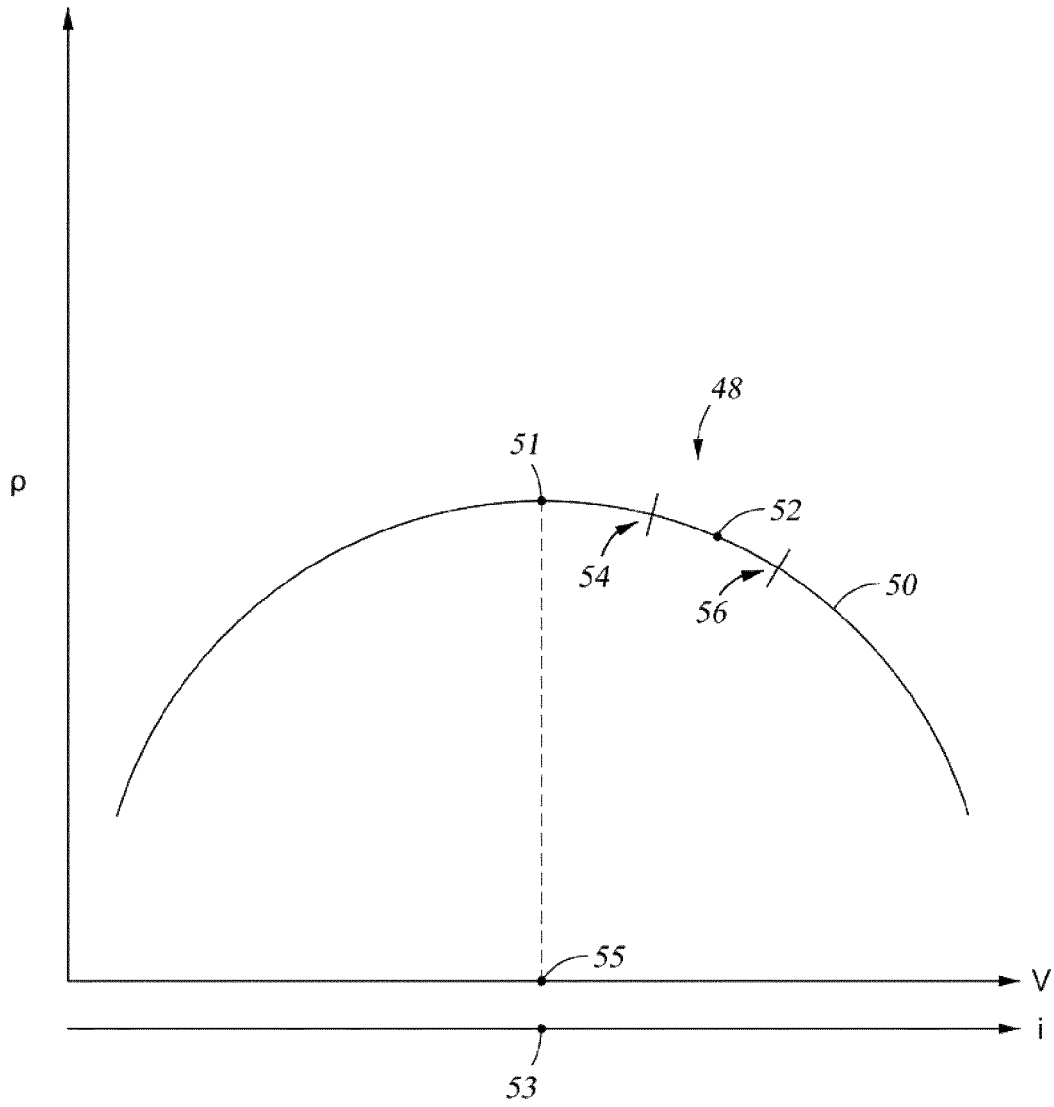
FIG. 7 illustrates a power curve for a wireline.

FIG. 7 includes a plot 48 with an impedance curve 50 modeling cable/wireline impedance. The plot 48 abscissa represents voltage and current in the cable with power in the cable illustrated on the plot 48 ordinate. The peak power transmissible through the cable/wireline occurs at the upper most portion of the curve 50, which is illustrated by the curve apex 51. The peak power through the cable/wireline occurs at corresponding voltage 55 and current 53.

In some instances the downhole tool resistive load is assigned a predetermined or designated value for voltage. In one example, when the resistive load comprises a motor, the designated value may be its motor rating and will include a preferred voltage by which the motor, or other resistive load, is to be operated. The rated voltage may or may not correspond to the voltage 55 corresponding to peak power. A motor voltage rating point 52 provided on the curve 50 that differs from the peak power voltage 55. In this example motor power output can be maximized by delivering a voltage to the wire line having a magnitude proximate to the peak power voltage 55 while delivering voltage to the motor with a value proximate to the motor voltage rating 52.

In one mode of operation of the present system and method described herein, the current from the power supply 20 is monitored. Using the impedance model for the associated cable 18 (or wireline) the voltage at the resistive load 16 is estimated. In one embodiment the voltage is estimated at or just above the downhole tool 12 where the wireline 18 joins the downhole tool 12; this position is commonly referred to as the cablehead (not shown). If the estimated voltage is not at an optimal value, i.e. does not maximize power transfer through the cable 18 or operate the resistive load 16 efficiently, the power supply voltage can be harmonized with the power consumed. The method of downhole tool operation described herein includes dynamically harmonizing power supply with power usage during operations to maximize electrical power efficiency. Voltage regulation can be accomplished by the controller 21 or surface personnel to thereby adjust the voltage at the resistive load 16 to, or close to, the load's 16 desired or rated value. Optionally, the voltage can also be adjusted from the power supply 20 so the voltage in the cable 18 corresponds to the voltage for maximum power transfer through the cable 18.

The steps of monitoring and adjusting are repeatable. The repeating steps may be based on a time sequence, either alternating or periodic. The repeating steps may also be based on notification of an operating condition excursion, where such an excursion can include temperature, power, voltage, or current. The excursion can occur at any location in the system 10 or elsewhere. Accordingly, the present method includes a dynamic monitoring system and dynamic adjustments (if necessary). Optionally, the discrete time periods between the steps of monitoring and/or adjusting may be sufficiently close to approximate a continuous monitoring and adjusting. Similarly, the method is not limited to monitoring voltage, but may involve monitoring of current alone from the power source 20 as well as total power from the power source 20.

Referring to FIG. 7, the curve 50 includes an upper voltage range 54 and a lower voltage range 56. Many resistive loads, while having an optimal input voltage, also have a range of input voltages. In an example of use, the power supply 20 can be regulated so the motor operates between the lower and upper voltage range 54, 56. The voltage from the power supply 20 can be regulated to minimize differences between actual voltage in the cable 18 and its voltage for maximum power transfer. Thus in one example of optimizing the system displayed in FIG. 7, the step of regulating voltage from the power supply 20 would consider both the voltage of maximum power transfer for the cable 18 and the range of voltages 54, 56.

In addition to adjusting the voltage supply to the resistive load 16, the current used by the resistive load 16 can be controlled to coincide with the corresponding current 53 through the cable 18 for maximum power transfer. In one example, where the resistive load comprises the cutting tool 110 of FIG. 2, the feed motor 120 current requirement is controllable by adjusting motor 120 operation. In one example adjusting motor operation 120 includes adjusting the cutting member 134 feed rate, that can increase electrical current requirements for the feed motor 120. The term feed rate can relate to the rate at which the cutting member 134 extends away from the cutting tool 110 into or towards the tubular. Feed rate can also relate to the rate at which material is removed from the tubular being cut.

Figure 8:
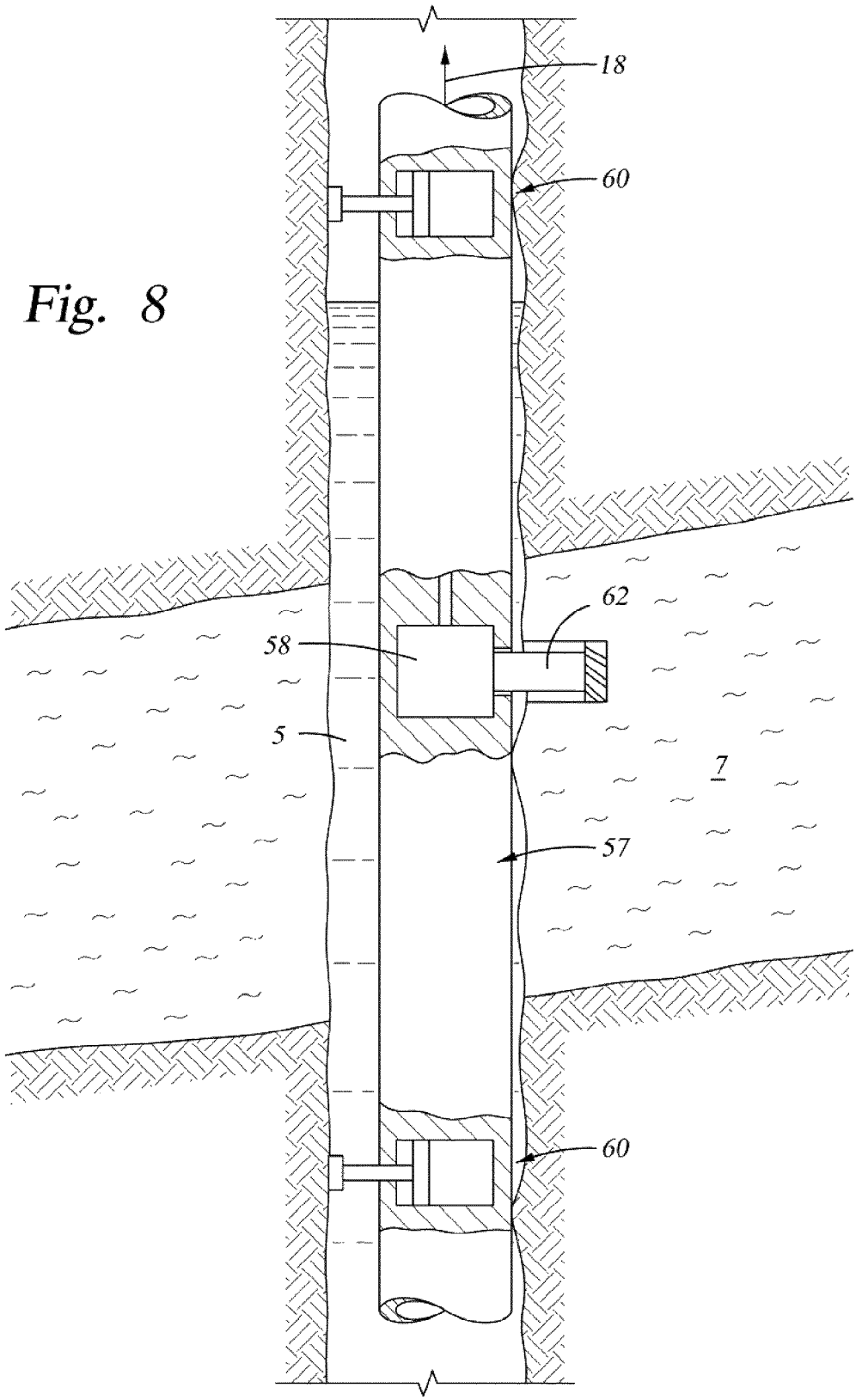
FIG. 8 is a side partial cross-sectional view of a downhole tool that comprises a coring device.

FIG. 8 illustrates a coring tool 57 example in a side partial sectional view. The coring tool 57 includes a pair of urging means 60 to push a side of the tool against the wellbore 5 side and proximate to a formation 7. A motor 58 drives a coring bit 62 shown laterally extending from the tool 57 and engaging the formation 7. The motor 58 is one example of a resistive load of a downhole tool that could be used in conjunction with the present method when powering the tool on a cable 18.

Wireline 18 impedance can be estimated by knowing its cross sectional area, length, and material. Maximum power transfer through the cable 18 can occur when the equivalent downhole tool load equals or is substantially equal to wireline impedance. Varying downhole tool operation to harmonize the tool load with the wireline impedance is one technique available for maximizing power transfer to the downhole tool from a surface power source. When the downhole tool is a cutting tool 110 for cutting a tubular, the pivot feed rate of the cutting member 134 can be varied to change the feed motor 120 load to harmonize the load to impedance values. Optionally, the main motor 122 operation can be adjusted to increase or decrease cutting member 134 rotational speed to harmonize load and impedance values for maximum power transfer through the wireline 18. Adjustments to motor operation must still consider operational constraints such as minimum cutting speed necessary to prevent the binding the cutting element, maximum and minimum voltage to the motors, and maximum and minimum current to the motors.

Figure 9A:
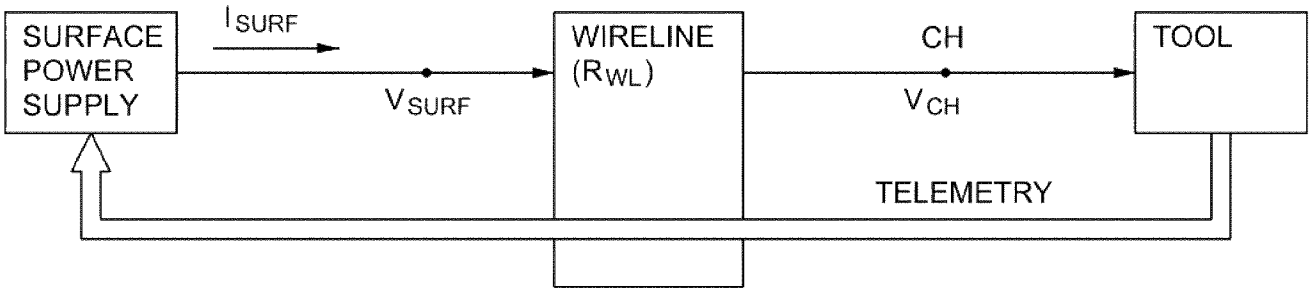
FIG. 9A schematically depicts an example of a telemetry feedback control.
Figure 9B:
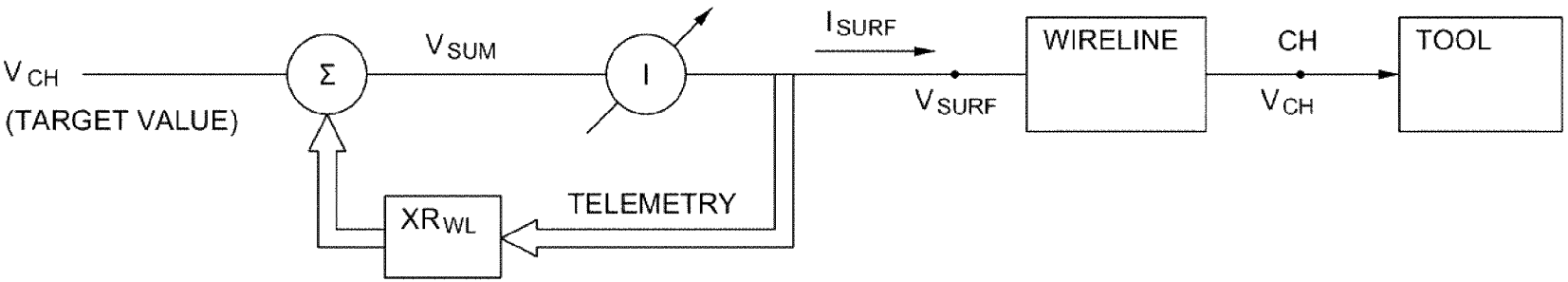
FIG. 9B is a schematic example of a feed forward control.

The cablehead voltage can be regulated by either feedback (FIG. 9A) or feed forward (FIG. 9B) control. An example of a feedback control loop is schematically illustrated in FIG. 9A depicting the cablehead voltage monitoring via telemetry during operation. In this example the actual wireline impedance ($R_{WL}$) can be estimated based on dividing the power source current ($I_{SURF}$) into the difference of the voltage source voltage output ($V_{SURF}$) and measured cablehead voltage ($V_{CH}$). This method can account for wireline impedance variations due to changes in temperature or wireline dimensions while downhole. However during tool operation, such as when the tool is a tubing cutter, real time telemetry measurement may suffer interference from operational noise. During this time a feed forward method using a previously measured wireline impedance can be employed. FIG. 9B provides a schematic example of a feed forward loop. In this embodiment, wireline impedance can be measured or calculated before tool deployment. Optionally, wireline impedance can be measured as the tool is powered up using cablehead voltage telemetry measurements. One advantage of feed forward control is the use of a single wireline that reduces cable cross sectional area within the borehole, this enables use of the device in higher pressure wellbores.

Figure 10:
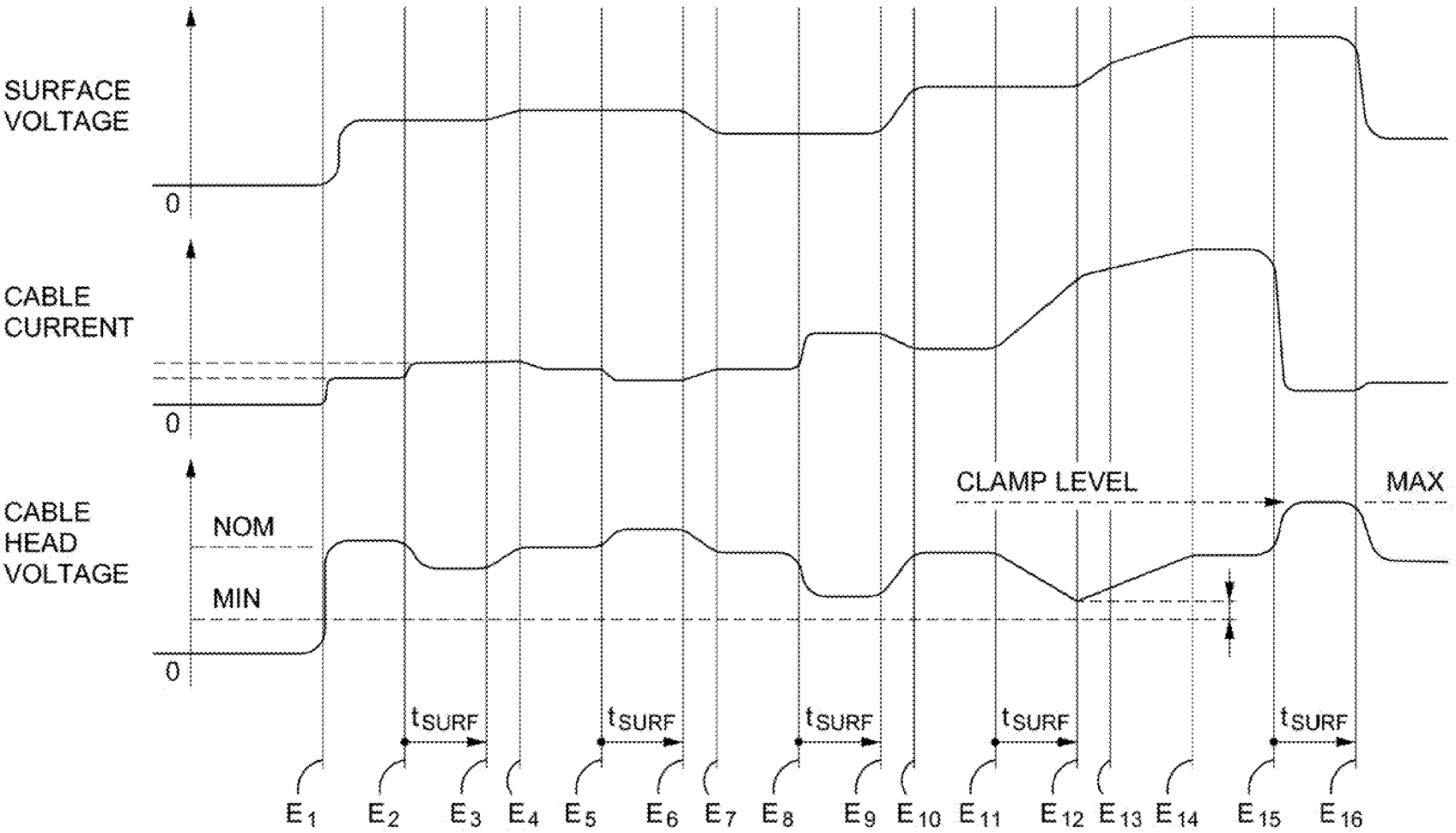
FIG. 10 graphically illustrates voltage and current values during a cutting tool operational sequence.

FIG. 10 graphically illustrates surface voltage, cable current, and cablehead voltages during an example of a cutting tool operation in accordance with a method herein described. At event $E_1$ tool power is on and surface power supply is turned on, the cable current increases to downhole tool idle consumption level, and the cablehead voltage is constant. At event $E_2$ the hydraulic motor is started to put arms in the opening sequence and lock tool arms to the tubular inner surface, cablehead voltage drops as cable current increases. During event $E_3$ surface voltage feedback control starts to adjust its output level after a delay from the previous event. Surface power supply output gradually adjusts to regulate cablehead towards target nominal voltage level. Surface voltage feedback control completes its output level adjustment at event $E_4$ and surface voltage, cable current, and cablehead voltage are constant. Cablehead is regulated at its nominal target voltage. Event $E_5$ illustrates where the extension of arms is completed and they are locked to tubular. Hydraulic motor switches to low power mode set to keep arms pushed against tubular.

Event $E_6$ depicts where surface voltage feedback control starts to adjust its output level after a delay from the previous event. Surface power supply output gradually adjusts to regulate cablehead voltage towards target nominal voltage level. Surface voltage feedback control completes its output level adjustment as shown at event $E_7$. Surface voltage, cable current and cablehead voltage are constant and cablehead voltage is at nominal target voltage. Event $E_8$ shows main motor starts rotating the cutting element and the feed motor begins to pivot the cutting element towards the tubular to sense the tubular inner surface. Losses in this phase are associated with electrical and mechanical operational inefficiencies not including any power consumed by the cutting process. Here cablehead voltage drops as the cable current increases. Optionally, the tubular inner surface could be contacted by the cutting element before rotating the element to prevent damage to the cutting element teeth.

Event $E_9$ shows where surface voltage feedback control starts to adjust its output level after a delay from the previous event. Surface power supply output gradually adjusts to regulate cablehead voltage towards target nominal voltage level. Surface voltage feedback control completes its output level adjustment at event $E_{10}$. Surface voltage, cable current, and cablehead voltage remain constant; and cablehead voltage is regulated at nominal target voltage. The cutting element has located the tubular inner circumference in event $E_{11}$ with the outward pivoting procedure. Optionally, the cutting element may be retracted just a small distance from the tubular and rotated before being pivoted outward. As the cutting element begins its cut into the tubular, power demand grows as the power consumed by the cutting process increases. Consequently, cablehead voltage drops as the cable current increases. As shown at event $E_{12}$ surface voltage feedback control starts to adjust its output level after a delay from the previous event. Surface power supply output gradually adjusts to regulate the cablehead voltage towards target nominal voltage level. The surface power supply voltage can react before the cablehead voltage is lowered to the motors' minimum voltage level requirement; thereby maintaining the cutting element's angular speed/feed rate. At this stage, the cable current rate of increase changes, the surface voltage increases thereby reversing the cablehead voltage lowering trend.

During event $E_{13}$ the cutting process reaches a power demand plateau that remains fairly constant until the end of the cut. Between event $E_{12}$ and event $E_{14}$ the surface power supply trends upward in response to ongoing cutting process power demand increases. At event $E_{14}$, after power demand plateau, the surface power supply feedback control stabilizes the surface voltage value. At event $E_{15}$ the cutting process ends and the power demand suddenly drops to idle consumption power levels. The cablehead voltage increases suddenly as the cable current decreases quickly to idle levels. The cablehead voltage is clamped to a maximum allowed voltage level chosen in order to protect the tools' electronics components and modules from high voltage exposure damage. The cablehead voltage clamping function should remain active until the surface power supply has time to reduce the cablehead voltage back to its target nominal voltage level. The voltage clamp module absorbs and dissipates excessive power available at the cablehead and resulting heat during the surface power supply feedback adjustment period. Illustrated at event $E_{16}$, after a delay (Tsurf) from the end of the cut, the surface power supply feedback makes the necessary adjustment required to reduce the cablehead voltage to the nominal target value and relieve the voltage clamp module.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of cutting a tubular downhole comprising:

a. providing a cutting tool within the tubular having a selectively rotatable and selectively pivoting cutting head, a main motor, a feed motor, an attached cable in electrical communication with the main and feed motors, the cable having a maximum value of power transfer, and a selectively rotatable cutting element mounted on the cutting head;

b. deploying the cutting tool in the tubular;

c. supplying electricity to the cable; and d. controlling electricity in the cable to match the value of actual power in the cable to the value of cable maximum power transfer.

2. The method of claim 1, wherein step (d) comprises adjusting the amount of electrical power in the cable.

3. The method of claim 1, wherein step (d) comprises adjusting a cutting tool operation.

4. The method of claim 3, wherein adjusting a cutting tool operation comprises changing a feed rate for the cutting element.

5. The method of claim 3, wherein adjusting a cutting tool operation comprises changing a rate of rotation of the cutting element.

6. The method of claim 3, wherein adjusting a cutting tool operation comprises changing a rate of rotation of the cutting head.

7. The method of claim 1, wherein step (d) comprises adjusting the amount of electricity supplied to the cable.

8. The method of claim 1, further comprising monitoring voltage at the cutting tool.

9. The method of claim 8, further comprising estimating impedance in the cable based on the monitored value of voltage at the cutting tool.

10. The method of claim 1, further comprising adding a voltage clamp to the cable, so that when electricity supplied to the cable for cutting tool operation and the cutting tool operation ceases, voltage in the cable is delivered to the voltage clamp.

11. The method of claim 1, wherein at least one of the feed motor and main motor has a motor voltage rating different from the voltage in the cable that corresponds to the maximum value of power transfer in the cable, and wherein step (d) comprises adjusting electrical supply in the cable so that voltage at the at least one of the feed motor and main motor is between the motor voltage rating and the voltage in the cable that corresponds to the maximum value of power transfer in the cable.

12. A method of operating a tool within a wellbore comprising:

a. providing a tool having a resistive load of varying value;

b. providing a wireline having a maximum value of power transfer;

c. connecting the wireline to the tool so that it is in electrical communication with the resistive load;

d. suspending the tool in the wellbore on an end of the wireline;

e. supplying electricity to the wireline and energizing the resistive load; and f. controlling the electricity in the wireline by minimizing the difference between the actual electrical power in the wireline and the maximum power transmission through the wireline.

13. The method of claim 12, wherein the step of adjusting the motor load comprises harmonizing the downhole tool electrical load with the wireline impedance to maximize power transfer through the wireline.

14. The method of claim 12, wherein the downhole tool comprises a tubular cutting device having a main motor, a feed motor, a cutting element, a drive train having an input connected to the main motor and an output connected to the cutting element, and a pivot mechanism having an side connected to the feed motor and an output connected to the cutting element, the tubular cutting device disposed within a tubular, the method further comprising activating the main motor thereby rotating the cutting element, activating the feed motor thereby pivoting the cutting element into cutting action against the tubular inner circumference, and adjusting the feed rate that the cutting element is pivoting against the tubular, wherein adjusting the motor load comprises adjusting the feed rate.

15. The method of claim 12, wherein the downhole tool comprises a tubular cutting device having a main motor, a feed motor, a cutting element, a drive train having an input connected to the main motor and an output connected to the cutting element, and a pivot mechanism having an side connected to the feed motor and an output connected to the cutting element, the tubular cutting device disposed within a tubular, the method further comprising activating the main motor thereby rotating the cutting element, activating the feed motor thereby pivoting the cutting element into cutting action against the tubular inner circumference, and adjusting the cutting element rotational rate that the cutting element rotates, wherein adjusting the motor load comprises adjusting the cutting element rotational rate.

16. The method of claim 12, further comprising providing an electrical clamp coupled with the wireline.

17. The method of claim 12, further comprising providing a power supply and measuring voltage at the power supply output, measuring voltage at the downhole tool input, measuring current at the power supply output, and estimating wireline impedance based on the measured voltages and current.

18. The method of claim 12, wherein the downhole tool comprises a cutting tool for cutting a tubular and wherein the step of estimating wireline impedance is performed at a time selected from the list consisting of when the cutting tool is not in cutting engagement with the tubular and when the cutting tool is in cutting engagement with the tubular.

19. The method of claim 12 wherein the downhole tool comprises a coring tool.

20. A method of operating a downhole tool in a wellbore on cable, the downhole tool having a housing and motor therein and the cable having an impedance, the method comprising:

connecting an upper end of the cable to an electrical power supply;

attaching the tool to a lower end of the cable;

lowering the tool into the wellbore on the cable;

supplying electrical power from the power supply to the tool through the cable;

operating the motor in a mode that produces a motor load, and selectively manipulating motor operation to match the motor load with the cable impedance.

21. The method of claim 20, further comprising estimating cable impedance during tool operation.

* * * * *

UNITED STATES PATENT AND TRADEMARK OFFICE
Certificate

Patent No. 7,987,901 B2 Patented: August 2, 2011

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Sven Krueger, Winsen (DE); Otto N. Fanini, Houston, TX (US); Matthias Reinhard Moeller, Braunschweig (DE); Karsten Fuhst, Hannover (DE); and William Befeld, Richmond, TX (US).

Signed and Sealed this Fourteenth Day of February 2012.

SHANE BOMAR
*Supervisory Patent Examiner*
Art Unit 3676
Technology Center 3600